US009354539B1

(12) United States Patent
Tanaka

(10) Patent No.: US 9,354,539 B1
(45) Date of Patent: May 31, 2016

(54) IMAGE FORMING APPARATUS WITH HOLDING UNIT FOR CHARGING ELECTRODE

(71) Applicants: KABUSHIKI KAISHA TOSHIBA, Tokyo (JP); TOSHIBA TEC KABUSHIKI KAISHA, Tokyo (JP)

(72) Inventor: Yoshiaki Tanaka, Numazu Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/699,967

(22) Filed: Apr. 29, 2015

(51) Int. Cl.
*G03G 15/02* (2006.01)

(52) U.S. Cl.
CPC ..... *G03G 15/0291* (2013.01); *G03G 2215/028* (2013.01)

(58) Field of Classification Search
CPC ..... G03G 15/0291; G03G 2215/026; G03G 2215/027; G03G 2215/028
USPC ..... 399/170–173
See application file for complete search history.

(56) References Cited

U.S. PATENT DOCUMENTS

| | | | | | |
|---|---|---|---|---|---|
| 3,655,966 | A * | 4/1972 | Takimoto | G03G 15/0291 | 250/324 |
| 4,203,144 | A * | 5/1980 | Okamoto | G03G 15/0291 | 250/324 |
| 4,233,511 | A * | 11/1980 | Harada | G03G 15/0291 | 250/324 |
| 5,324,942 | A * | 6/1994 | Mishra | G03G 15/0291 | 250/324 |
| 5,339,137 | A * | 8/1994 | Kusumoto | G03G 15/0266 | 399/170 |
| 6,741,444 | B2 * | 5/2004 | Jacobs | G03G 15/0291 | 361/212 |
| 7,187,534 | B2 * | 3/2007 | Mishra | G03G 15/0291 | 361/220 |
| 7,684,735 | B2 * | 3/2010 | Ino | G03G 15/0291 | 399/171 |

FOREIGN PATENT DOCUMENTS

JP 03249776 A * 11/1991

* cited by examiner

*Primary Examiner* — Robert Beatty
(74) *Attorney, Agent, or Firm* — Patterson & Sheridan, LLP

(57) ABSTRACT

A holding module includes a photoreceptor configured to hold an electrostatic latent image on a surface thereof, a charging electrode that extends in a width direction of the photoreceptor and is configured to charge the surface of the photoreceptor, the charging electrode including a base portion and a discharging portion disposed between the base portion and the photoreceptor and from which electricity is discharged towards the photoreceptor, and a holding unit that holds the charging electrode and deforms the charging electrode, such that a distance between the discharging portion and the surface of the photoreceptor is different along the width direction of the photoreceptor.

20 Claims, 10 Drawing Sheets

IMAGE FORMING APPARATUS WITH HOLDING UNIT FOR CHARGING ELECTRODE

FIELD

Embodiments described herein relate generally to a holding module and an image forming apparatus.

BACKGROUND

In an image forming apparatus that forms a toner image, an electrostatic latent image is formed on a photoreceptor that is charged by a charger, based on image data. Then, the electrostatic latent image is developed with toner that is supplied from a developing unit. In such an image forming apparatus, the toner image on the photoreceptor may have uneven density in a width direction thereof for various reasons. For example, the uneven density of the toner image may be caused when a developing property of the developing unit is different in the width direction.

DETAILED DESCRIPTION

Figure 1:
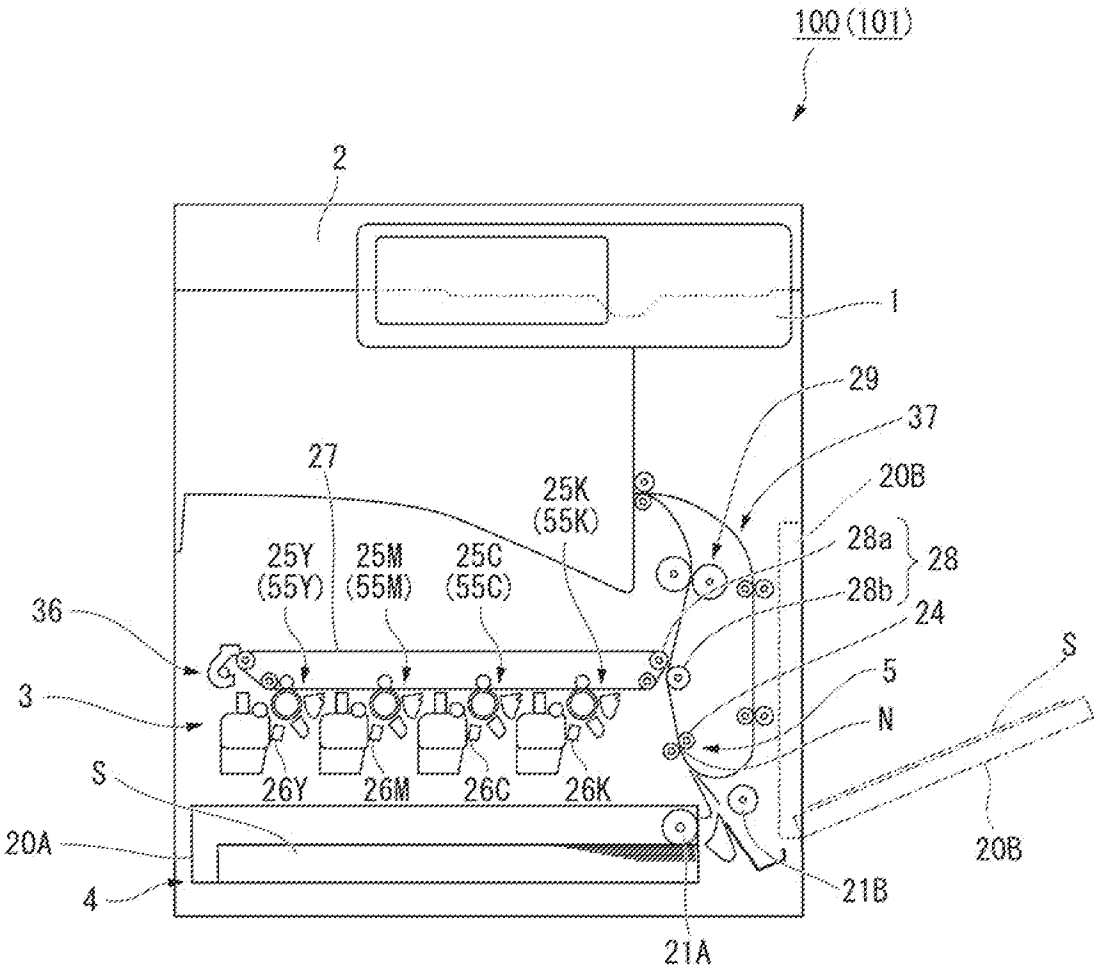
FIG. 1 is a schematic cross sectional diagram of an image forming apparatus according to a first embodiment.

In general, according to one embodiment, a holding module includes a photoreceptor configured to hold an electrostatic latent image on a surface thereof, a charging electrode that extends in a width direction of the photoreceptor and is configured to charge the surface of the photoreceptor, the charging electrode including a base portion and a discharging portion disposed between the base portion and the photoreceptor and from which electricity is discharged towards the photoreceptor, and a holding unit that holds the charging electrode and deforms the charging electrode, such that a distance between the discharging portion and the surface of the photoreceptor is different along the width direction of the photoreceptor.

First Embodiment

Hereinafter, an image forming apparatus 100 according to a first embodiment will be described with reference to drawings. In addition, in each figure, the same configuration will be given the same reference numeral.

Figure 2:
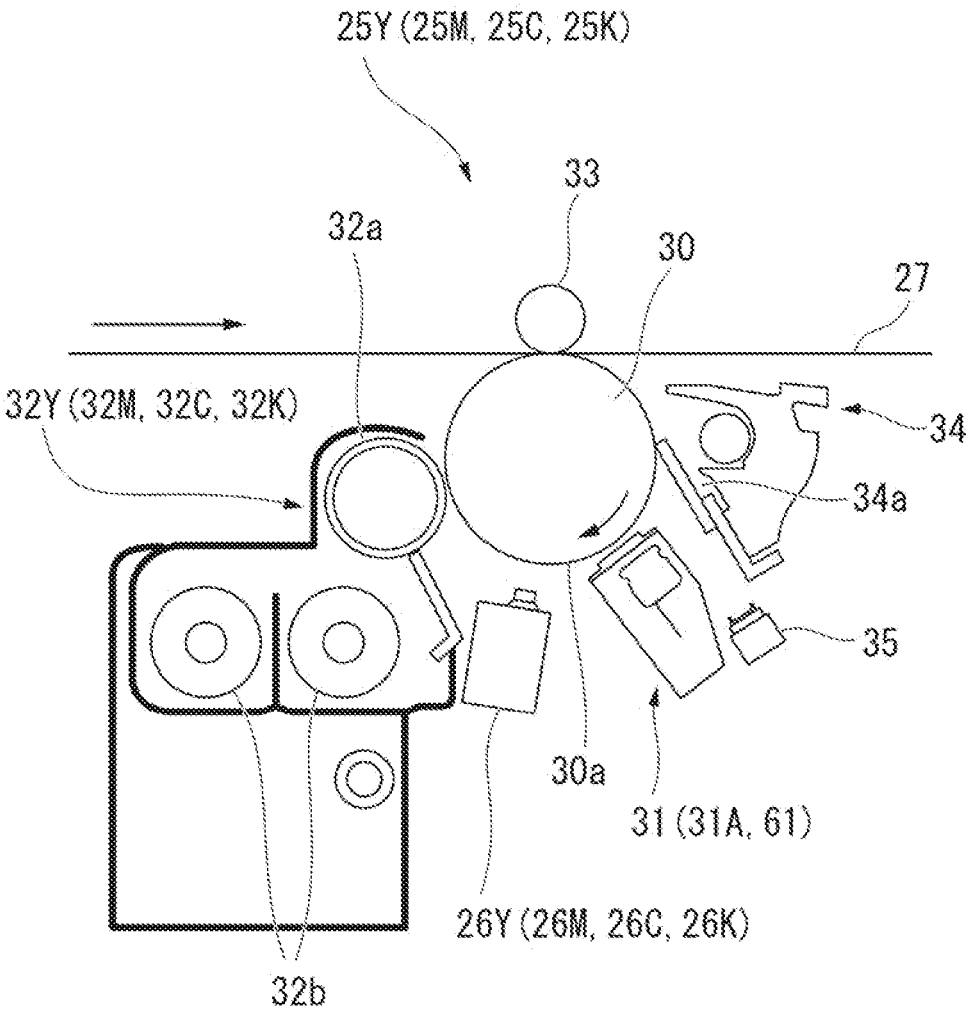
FIG. 2 is a schematic cross sectional diagram of main components of the image forming apparatus according to the first embodiment.

FIG. 1 is a schematic cross sectional diagram of the image forming apparatus 100 according to the first embodiment. FIG. 2 is a schematic cross sectional diagram of main components of the image forming apparatus according to the first embodiment.

As illustrated in FIG. 1, the image forming apparatus 100 includes a control panel 1, a scanner unit 2, a printer unit 3, a sheet accommodating unit 4, and a transport unit 5.

The scanner unit 2 generates image data of a copying target based on intensity of light received thereon. The scanner unit 2 outputs the image data to the printer unit 3.

The printer unit 3 forms an output image using developer including toner, or the like, (hereinafter, referred to as toner image) based on the image data from the scanner unit 2 or image data from an external device. The printer unit 3 transfers the toner image on to the surface of a sheet S. The printer unit 3 fixes the toner image on the sheet S by applying heat and pressure to the toner image on the surface of the sheet S.

The sheet accommodating unit 4 supplies the sheets S one by one to the printer unit 3 at timing of forming the toner image at the printer unit 3. The sheet accommodating unit 4 includes one or more sheet feeding cassettes 20A and a manual feed tray 20B. In FIG. 1, one sheet feeding cassette 20A is provided. The sheet feeding cassette 20A accommodates a sheet S of a predetermined size and type. In the manual feed tray 20B, it is possible to dispose a sheet S of various sizes when the tray is open on the side.

The sheet feeding cassette 20A includes a sheet feeding roller 21A. The manual feed tray 20B includes a sheet feeding roller 21B. Each of sheet feeding rollers 21A and 21B takes out the sheets S one by one from the sheet feeding cassette 20A and the manual feed tray 20B, respectively. The sheet feeding rollers 21A and 21B convey the sheet S which is taken out, to the transport unit 5. Hereinafter, when not being specifically stated, the sheet S is conveyed to the transport unit 5 by the sheet feeding roller 21A, as an example.

The transport unit 5 includes a resist roller 24. The transport unit 5 guides the sheet S to the resist roller 24 using the sheet feeding roller 21A or 21B. The resist roller 24 transports the sheet S during transferring the toner image on the sheet S using the printer unit 3.

For example, the sheet feeding roller 21A supplies the sheet S to the transport unit 5. The sheet feeding roller 21A causes a tip end of the sheet S in the transport direction to contact a nip N of the resist roller 24. The sheet feeding roller 21A adjusts a position of the tip end of the sheet S in the transport direction while the sheet S is bent. The resist roller 24 causes the tip end of the sheet S to be aligned at the nip N. In addition, the resist roller 24 transports the sheet S towards the transfer unit 28, which will be described below.

The printer unit 3 includes image forming units 25Y, 25M, 25C, and 25K, exposure units 26Y, 26M, 26C, and 26K, an intermediate transfer belt 27, the transfer unit 28, and a fixer 29.

Each of the image forming units 25Y, 25M, 25C, and 25K forms a toner image, which will be transferred to the sheet S, on the intermediate transfer belt 27.

As illustrated in FIG. 2, the image forming units 25Y, 25M, 25C, and 25K respectively include a cylindrical photosensitive drum 30 (photoreceptor). Each photosensitive drum 30 includes a photoreceptor layer on the surface.

Each of the photosensitive drums 30 is disposed on a lower side of the intermediate transfer belt 27, which will be described below, being separated from each other. Each of the photosensitive drums 30 is connected to a driving motor. Due to the driving motor, each of the photosensitive drum 30 rotates clockwise in FIG. 2.

The charger 31, the exposure unit 26Y, (26M, 26C, 26K), the developing unit 32Y (32M, 32C, 32K), the transfer roller 33, the cleaning unit 34, and a static eliminator 35 are disposed in this order in the clockwise direction at the circumference of the photosensitive drum 30.

The charger 31 charges the photosensitive drum 30. According to the embodiment, the charger 31 charges the photosensitive drum 30 so as to be a negative potential. A configuration of the charger 31 will be described below.

The exposure units 26Y, 26M, 26C, and 26K irradiates the surface 30*a* of the charged photosensitive drum 30 with LED light of which emission is controlled based on the image data. Pieces of image data of yellow, magenta, cyan, and black are respectively supplied to the exposure units 26Y, 26M, 26C, and 26K. After the charging, the exposure units 26Y, 26M, 26C, and 26K emit LED light based on the image data to each of the photosensitive drums 30. The exposure units 26Y, 26M, 26C, and 26K form an electrostatic latent image based on the image data on the surface 30*a* of the photosensitive drum 30.

The developing units 32Y, 32M, 32C, and 32K respectively store yellow toner, magenta toner, cyan toner, and black toner. The developing units 32Y, 32M, 32C, and 32K charge each of the stored toner.

The developing units 32Y, 32M, 32C, and 32K supply the charged toner onto the surfaces 30*a* of the photosensitive drums 30, which face the respective developing units. The developing units 32Y, 32M, 32C, and 32K develop the electrostatic latent images which are formed by the exposure units 26Y, 26M, 26C, and 26K. The developed toner image is attached onto the surface 30*a* of the photosensitive drum 30.

The developing units 32Y, 32M, 32C, and 32K perform the developing using toner of a two-component type. The developing units 32Y, 32M, 32C, and 32K respectively include a mixer 32*b* and a magnetic roller 32*a*. The mixer 32*b* uniformly charges toner by agitating developer including the toner. The magnetic roller 32*a* causes the developer to be in contact with the surface 30*a* of the photosensitive drum 30.

The transfer roller 33 is opposite to the photosensitive drum 30 across the intermediate transfer belt 27 which is in contact with the surface 30*a* of the photosensitive drum 30 between the transfer roller 33 and the photosensitive drum 30. The transfer roller 33 transfers the toner image on the surface 30*a* of the photosensitive drum 30 onto the intermediate transfer belt 27 (primary transfer).

Each of image forming units 25Y, 25M, 25C, and 25K applies a transfer bias to each of the transfer rollers 33 at the respective primary transfer position.

The cleaning unit 34 includes a cleaning blade 34*a* which is in contact with the surface 30*a* of the photosensitive drum 30 that has passed the primary transfer position. The cleaning blade 34*a* scratches out remaining toner from the surface 30*a* of the photosensitive drum 30. The cleaning unit 34 stores the toner which is scratched out using the cleaning blade 34*a*. The cleaning unit 34 stores the toner which is scratched out using the cleaning blade 34*a* in the toner tank.

The static eliminator 35 radiates light towards the surface 30*a* of the photosensitive drum 30 that has passed through the cleaning blade 34*a*. The static eliminator 35 discharges the photosensitive drum 30.

As illustrated in FIG. 1, the intermediate transfer belt 27 is an endless belt. The intermediate transfer belt 27 moves in synchronization with a rotation of each photosensitive drum 30 of each of image forming units 25Y, 25M, 25C, and 25K.

Each of the image forming units 25Y, 25M, 25C, and 25K transfers toner images of each color on the intermediate transfer belt 27 so that the toner images are overlapped. The image forming units 25Y, 25M, 25C, and 25K form a color toner image on the intermediate transfer belt 27.

In the intermediate transfer belt 27, a transfer belt cleaning unit 36 is disposed at a position neighboring the image forming unit 25Y with an interval. The transfer belt cleaning unit 36 scratches out toner remaining on the surface of the intermediate transfer belt 27. The transfer belt cleaning unit 36 stores the toner which is scratched out in a waste toner tank.

The transfer unit 28 is disposed at a position neighboring the image forming unit 25K within a loop of the intermediate transfer belt 27.

The transfer unit 28 transfers the toner image which is charged on the intermediate transfer belt 27 onto the surface of the sheet S at a secondary transfer position. In the transfer unit 28, the secondary transfer position is set to a position at which a support roller 28*a* and a secondary transfer roller 28*b* are opposite to each other. The transfer unit 28 applies a transfer bias, which is controlled based on a transfer current, to the secondary transfer position. The transfer unit 28 transfers the toner image on the intermediate transfer belt 27 to the sheet S using the transfer bias.

The fixer 29 causes the toner image on the surface of the sheet S to be fixed onto the sheet S using heat and pressure which are applied to the sheet S.

The printer unit 3 includes a reversing unit 37. The reversing unit 37 reverses the sheet S which is discharged from the fixer 29 using a switching back structure. The reversing unit 37 transports the reversed sheet S in the transport unit 5 in front of the resist roller 24. The reversing unit 37 reverses the sheet S in order to form an image on the rear surface.

Subsequently, a configuration of the charger 31 will be described.

Figure 3:
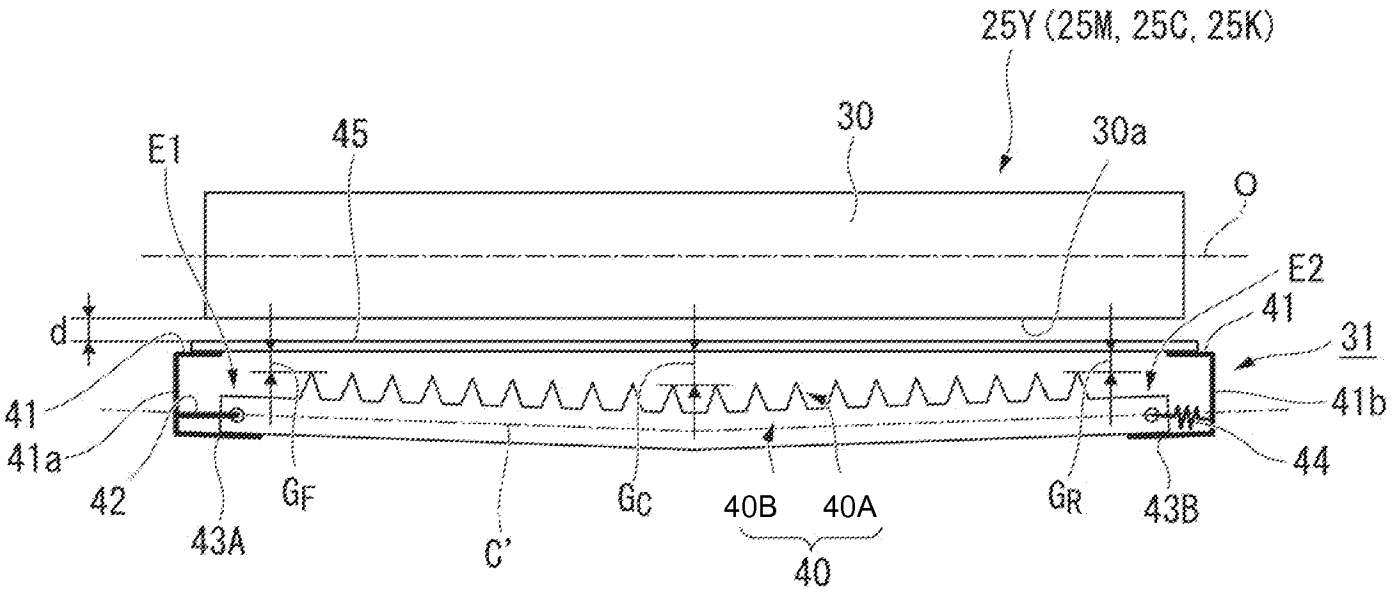
FIG. 3 is a schematic cross sectional diagram of a charger of the image forming apparatus according to the first embodiment.
Figure 4:
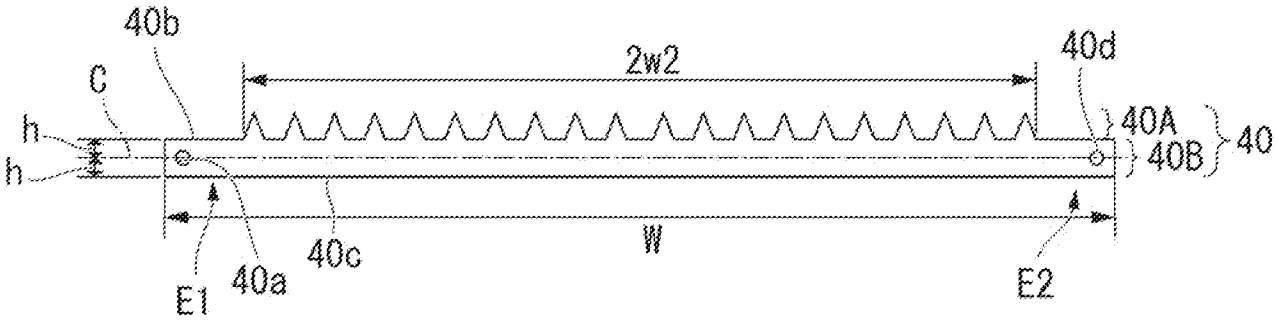
FIG. 4 is a front view of the charger of the image forming apparatus according to the first embodiment.
Figure 5:
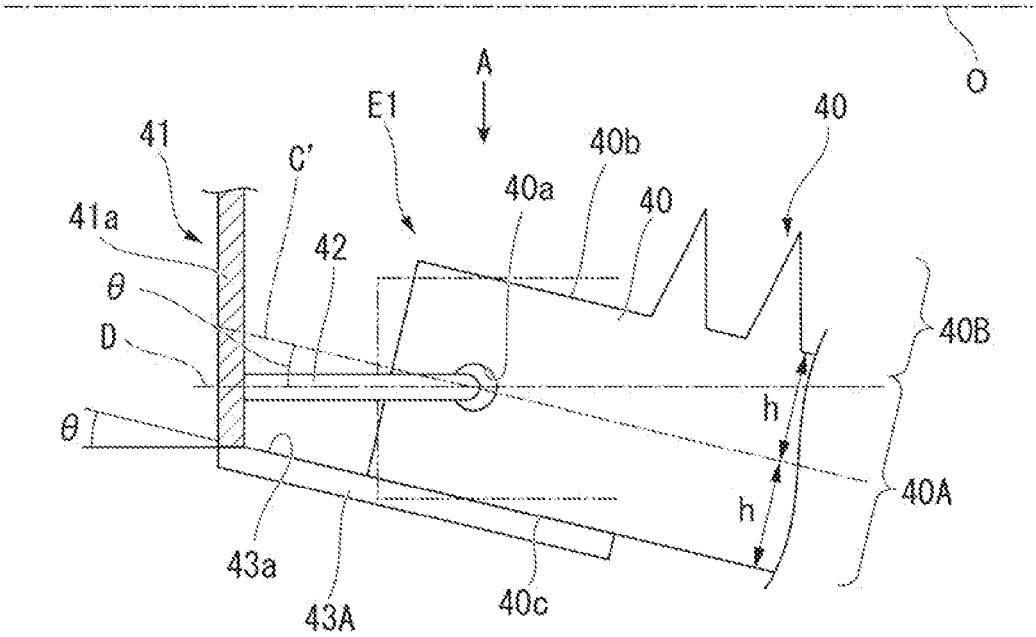
FIG. 5 is a schematic cross sectional diagram of a first end portion of the charger of the image forming apparatus according to the first embodiment.
Figure 6:
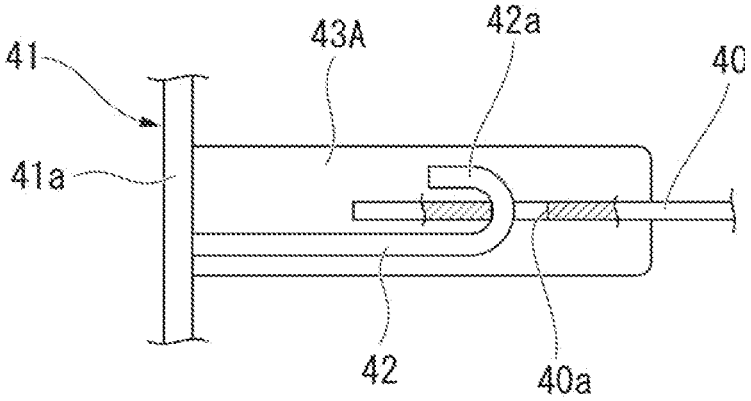
FIG. 6 is a diagram which is taken along line VI in FIG. 5.
Figure 7:
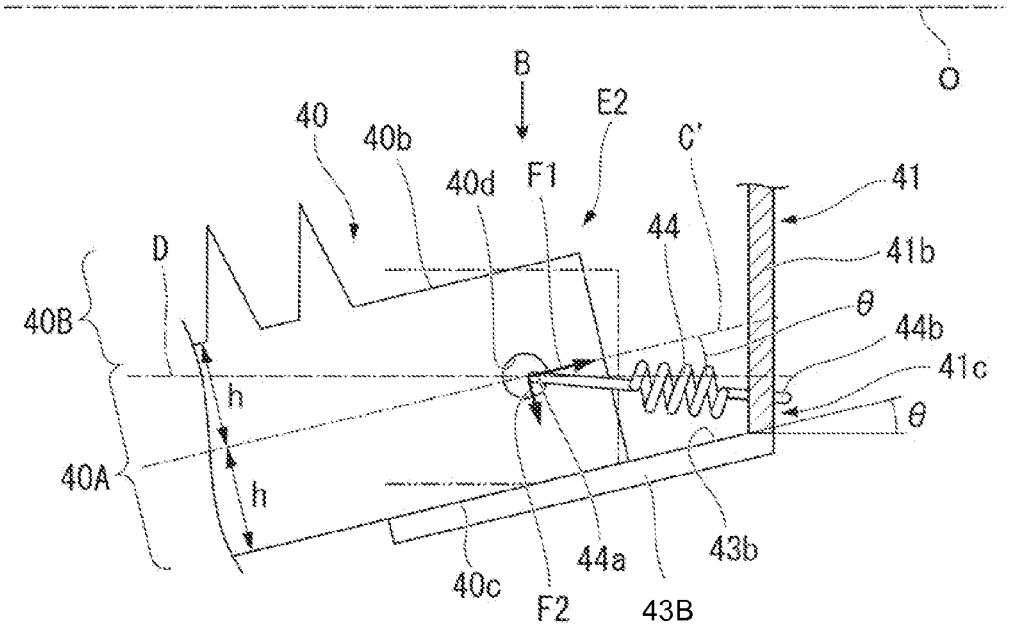
FIG. 7 is a schematic cross sectional diagram of a second end portion of the charger of the image forming apparatus according to the first embodiment.
Figure 8:
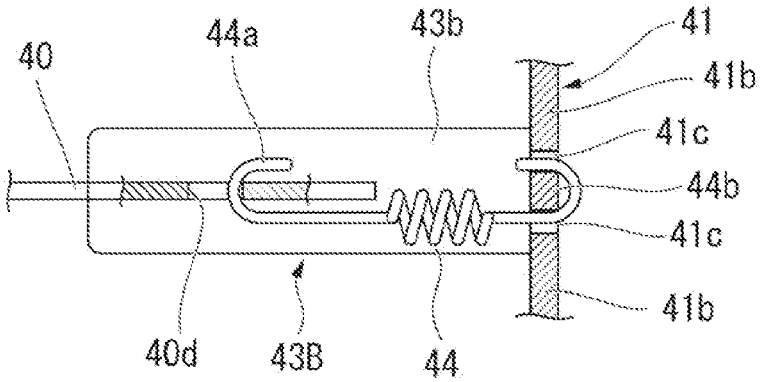
FIG. 8 is a diagram which is taken along line VIII in FIG. 7.

FIG. 3 is a schematic cross sectional diagram of the charger of the image forming apparatus according to the first embodiment. FIG. 4 is a front view of a charging electrode of the charger of the image forming apparatus according to the first embodiment. FIG. 5 is a schematic cross sectional diagram of a first end portion of the charger of the image forming apparatus according to the first embodiment. FIG. 6 is a diagram which is taken along line VI in FIG. 5. FIG. 7 is a schematic cross sectional diagram of a second end portion of the charger of the image forming apparatus according to the first embodiment. FIG. 8 is a diagram which is taken along line VIII in FIG. 7.

As illustrated in FIG. 3, the charger 31 includes a charging grid 45, a charging electrode 40, and a support frame (electrode holding member). The charger 31 is disposed along the surface 30*a* of the photosensitive drum 30. The surface 30*a* of the photosensitive drum 30 is parallel to a center axis line O of the photosensitive drum 30.

The charging grid 45 suppresses uneven electric discharging from the charging electrode 40. For example, the charging grid 45 is formed of a thin metal plate in which a plurality of holes is formed. The charging grid 45 is disposed so as to face the surface 30*a* of the photosensitive drum 30. A distance d between the surface of the charging grid 45 and the surface 30*a* of the photosensitive drum 30 is constant. The charging grid 45 is disposed in parallel to the surface 30*a* of the photosensitive drum 30. The charging grid 45 is disposed in parallel to the center axis line O of the photosensitive drum 30.

The charging grid 45 is disposed in a range in which at least an electrode portion 40A of the charging electrode 40, which will be described below, is covered.

The charging grid 45 is disposed at an opening portion of the support frame 41, which will be described below.

The charging electrode 40 discharges electricity toward the photosensitive drum 30. The charging electrode 40 charges the surface 30*a* of the photosensitive drum 30.

As illustrated in FIG. 4, the charging electrode 40 includes a belt-like portion 40B and the electrode portion 40A. The charging electrode 40 is formed of a metal plate.

The belt-like portion 40B is a rectangle which is long and thin with a length W and a width 2h (2h<W). The length W of the belt-like portion 40B is larger than the charging width in the image forming apparatus 100.

The electrode portion 40A protrudes from a first side surface 40*b* of the belt-like portion 40B in the short direction. The electrode portion 40A has a shape of a group of needles. The shape of the electrode portion 40A is not particularly limited when a tip end portion in the protruding direction is sharp. In FIG. 4, the electrode portion 40A is formed in an isosceles triangle is illustrated.

The electrode portion 40A is formed in a range of the width 2w2 (2w2<W), which is equal to or greater than the charging width in the image forming apparatus 100. The protruding length of the electrode portion 40A from the first side surface 40*b* is constant over the longitudinal direction of the charging electrode 40.

At a first end portion E1 of the belt-like portion 40B, a locking hole 40*a* (locking unit) is formed. The locking hole 40*a* is located on the center axis line C in the short direction. At a second end portion E2 of the belt-like portion 40B, a locking hole 40*d* (locking unit) is formed. The locking hole 40*d* is located on the center axis line C in the short direction. The locking holes 40*a* and 40*d* are holes which penetrate the belt-like portion 40B. Shapes of the locking holes 40*a* and 40*d* are not particularly limited. For example, the locking holes 40*a* and 40*d* may be circular holes, oval holes, polygonal holes, formless holes, or the like.

The charging electrode 40 is formed by cutting a thin metal plate in order to maintain a sharpness of the tip end portion of the electrode portion 40A. As will be described below, the charging electrode 40 is attached to the support frame 41. At this time, in the charging electrode 40, bending deformation occurs in a plate plane. Here, "bending deformation occurs in the plate plane" means that the bending deformation occurs in the plane which is orthogonal to the plate thickness direction of the charging electrode 40. A material and the plate thickness of the charging electrode 40 are selected so as to be subjected to bending deformation in the plate plane without being buckled on the outer side of the plate plane when being attached to the support frame 41.

As illustrated in FIG. 3, the support frame 41 holds the first end portion E1 and the second end portion E2 of the charging electrode 40. The support frame 41 is longer than the charging electrode 40. The support frame 41 changes a distance between the tip end portion of the electrode portion 40A in the protruding direction and the surface 30*a* of the photosensitive drum 30 along the region of the electrostatic latent image.

The support frame 41 includes support plate portions 41*a* and 41*b* on both end portions in the longitudinal direction. Though not illustrated in FIG. 3, the support plate portions 41*a* and 41*b* are connected by a side member which forms a side face of the support frame 41 in the short direction. In the support frame 41, an opening is formed on at least a side opposing the photosensitive drum 30. The opening is surrounded with the support plate portions 41*a* and 41*b*, and the side member.

As illustrated in FIGS. 5 and 6, the support frame 41 includes a locking portion 42 and an abutting portion 43A. The locking portion 42 and the abutting portion 43A hold the first end portion E1 of the charging electrode 40.

The locking portion 42 is fixed to the support plate portion 41*a*. The support plate portion 41*a* is located at an end portion of the support frame 41 in the longitudinal direction. The locking portion 42 extends from the support plate portion 41*a* toward an intermediate portion of the support frame 41 in the longitudinal direction. A hook 42*a* is provided at a tip end portion of the locking portion 42 in the extending direction. The hook 42*a* is inserted into the locking hole 40*a* of the charging electrode 40. The hook 42*a* is locked onto the inner circumferential face of the locking hole 40*a*. The locking portion 42 positions the locking hole 40*a* with respect to the support plate portion 41*a*.

The locking portion 42 is formed of metal. The locking portion 42 is electrically connected to a high-voltage power source. A voltage of the high-voltage power source is applied to the charging electrode 40. When the hook 42*a* is in contact with the locking hole 40*a* by being locked, the charging electrode 40 is electrically connected to the high-voltage power source.

The abutting portion 43A contacts a second side surface 40*c* of the first end portion E1 of the charging electrode 40. The abutting portion 43A has a flat plate shape. The first end portion E1 of the charging electrode 40 is locked to the hook 42*a*. The abutting portion 43A extends from the support plate portion 41*a* toward the intermediate portion of the support frame 41 in the longitudinal direction. A surface 43*a* (inclined face) facing the photosensitive drum 30 is formed in the abutting portion 43A. The surface 43*a* is inclined with respect to the surface 30*a* of the photosensitive drum 30. A distance between the surface 43*a* of the abutting portion 43A and the surface 30*a* of the photosensitive drum 30 gradually increases along the extending direction of the abutting portion 43A. An inclined angle of the surface 43*a* is θ (θ>0) with respect to a contact plane of the surface 30*a* of the photosensitive drum 30 which the charger 31 faces.

The abutting portion 43A is formed at a position at which a distance from a locking position of the locking hole 40*a* using the hook 42*a* is h. In the charging electrode 40 which is locked to the hook 42*a*, the second side surface 40*c* of the first end portion E1 is butted along the incline of the abutting portion 43A. The first end portion E1 of the charging electrode 40 is inclined with respect to the contact plane of the surface 30*a* of the photosensitive drum 30, and the center axis line O by an angle of θ similarly to the abutting portion 43A.

A center axis line C' when the charger 31 is attached forms an angle θ with an axis line D in the first end portion E1. The axis line D passes through a locking position of the hook 42*a* in the locking hole 40*a*. In addition, the axis line D is parallel to the surface 30*a* of the photosensitive drum 30 and the center axis line O. According to the embodiment, the axis line D is also parallel to the charging grid 45.

As illustrated in FIGS. 7 and 8, the support frame 41 includes a spring 44 (towing member, elastic member), and an abutting portion 43B. The spring 44 and the abutting portion 43B hold the second end portion E2 of the charging electrode 40 in the support frame 41.

The spring 44 is an elastic member. The spring 44 tows the second end portion E2 of the charging electrode 40. For example, as the spring 44, it is possible to use a coil spring, a flat spring, a torsion spring, or the like. According to the embodiment, as an example, the spring 44 is a coil spring. The spring 44 includes a hook 44*a* at one end and a hook 44*b* at the other end.

The hook 44*a* is inserted into the locking hole 40*d* of the charging electrode 40. The hook 44*a* is hooked onto the inner surface of the locking hole 40*d*. The hook 44*b* is inserted into a locking hole 41*c* which is formed in the support plate unit 41*b*. The hook 44*b* is hooked on the inner surface of the locking hole 41*c*. As the hooks 44*a* and 44*b* are hooked in the locking holes 40*d* and 41*c*, the spring 44 is stretched out so as to be longer than a natural length. The stretched spring 44 tows the charging electrode 40. The spring 44 stretches the charging electrode 40 without bending the charging electrode in a direction perpendicular to the plane of the charging electrode 40.

The locking hole 41*c* is formed at a position of the support plate unit 41*b* which is farther from the center axis line O than a position at which the axis line D intersects the support plate unit 41*b*.

The abutting portion 43B contacts the second side surface 40*c* of the second end portion E2 of the charging electrode 40. The abutting portion 43B has a flat plate shape. The second end portion E2 of the charging electrode 40 is locked by the hook 44*a*. The abutting portion 43B extends from the support plate unit 41*b* toward the intermediate portion of the support frame 41. A surface 43*b* (inclined face) facing the photosensitive drum 30 is formed in the abutting portion 43B. The surface 43*b* is inclined with respect to the surface 30*a* of the photosensitive drum 30. A distance between the surface 43*b* of the abutting portion 43B and the surface 30*a* of the photosensitive drum 30 gradually increases along the extending direction of the abutting portion 43B. An inclined angle of the surface 43*b* of the abutting portion 43B is θ (θ>0) with respect to the contact plane of the surface 30*a* of the photosensitive drum 30 which the charger 31 faces.

The inclined direction of the abutting portion 43B is opposite to the inclined direction of the abutting portion 43A.

In the charger 31, the spring 44 tows the charging electrode 40. The spring 44 is stretched between the locking hole 40*d* and the locking hole 41*c* on the axis line D. The locking hole 41*c* is provided so as to be closer to the abutting portion 43B than the axis line D. The second side surface 40*c* in the second end portion E2 of the charging electrode 40 is butted against along the surface 43*b* of the abutting portion 43B. The abutting portion 43B positions a locking position of the locking hole 40*d* and the hook 44*a* on the axis line D when the second side surface 40*c* butts against the surface 43*c*. A towing force of the spring 44 works in a direction in which the second end portion E2 of the charging electrode 40 is pressed against the surface 43*b* of the abutting portion 43B. As illustrated in FIG. 7, in the second end portion E2 of the charging electrode 40, component of a force F1 and component of a force F2 work due to the spring 44. The component of force F1 is a tensile force which is parallel to the surface 43*b* of the abutting portion 43B. The component of force F2 is a pressing force which is vertical to the surface 43*b* of the abutting portion 43B.

The second end portion E2 of the charging electrode 40 is pressed against the abutting portion 43B due to the component of force F2. In addition, the second end portion E2 of the charging electrode 40 is stretched due to the component of force F1. As a result, the second end portion E2 of the charging electrode 40 is inclined with respect to the surface 30*a* of the photosensitive drum 30 and the center axis line O by an angle θ similarly to the abutting portion 43B.

The support frame 41 is formed of a combination of metal and a synthetic resin. In the support frame 41, a portion which comes into contact with any one of the charging electrode 40, the locking portion 42, and the spring 44 is formed of a synthetic resin with electric insulation. For example, at least a part of the support plate portions 41*a* and 41*b* and the abutting portions 43A and 43B is formed of a synthetic resin with electric insulation.

With such a configuration, as illustrated in FIG. 3, the second side surface 40*c* of the first end portion E1 and the second end portion E2 is butted against the surfaces 43*a* and 43*b*. In the charging electrode 40, a bending moment in the opposite direction works in the first end portion E1 and the second end portion E2, respectively. In the charging electrode 40, a tensile force is generated due to towing of the spring 44. The charging electrode 40 is bent in the plane. As illustrated in FIG. 3, the belt-like portion 40B of the charging electrode 40 is curved in an arc shape which goes far from the photosensitive drum 30 at the intermediate portion in the longitudinal direction. The center axis line C of the belt-like portion 40B becomes a center axis line C' which is curved in an arc shape.

The electrode portion 40A protrudes from the first side surface 40*b* of the belt-like portion 40B. For this reason, each tip end portion of the electrode portion 40A is disposed along an arc-shaped curved line which is separated from the first side surface 40*b* which is curved in an arc shape by a constant distance.

Subsequently, operations of the image forming apparatus 100, especially operations of the charger 31, will be described.

Figure 9:
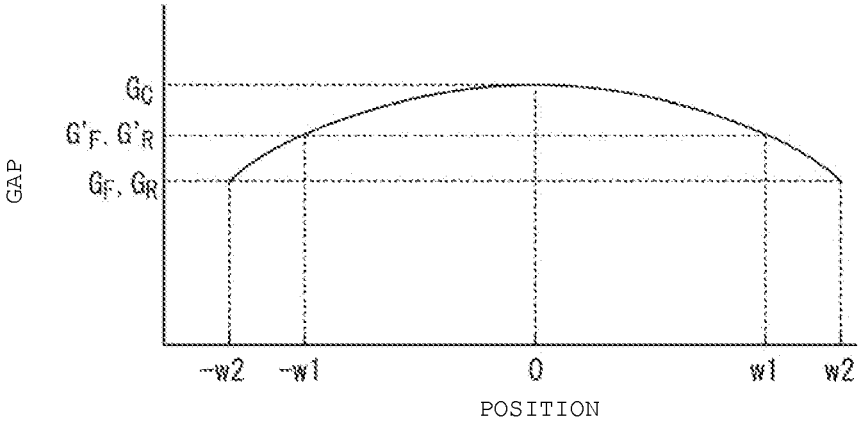
FIG. 9 is a graph which illustrates a gap between the charging electrode and a charging grid of the charger in a width direction of the charger.
Figure 10:
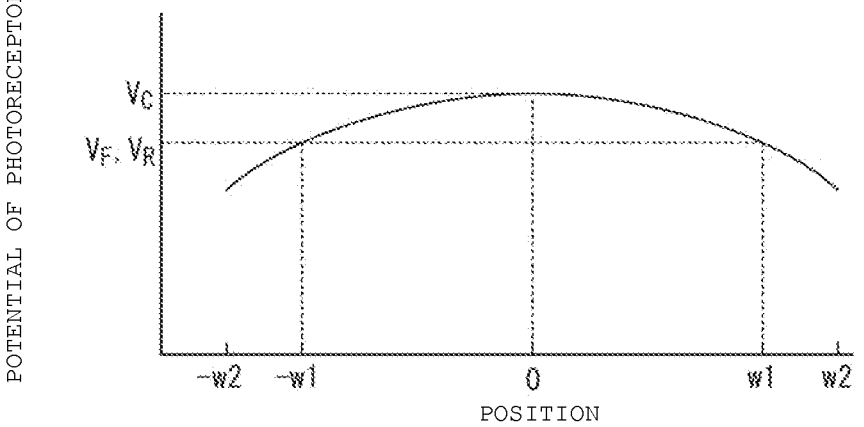
FIG. 10 is a graph which illustrates a potential of a photoreceptor charged by the charger of the image forming apparatus according to the first embodiment.

FIG. 9 is a schematic graph which illustrates a gap between the charging electrode and a charging grid of the charger of the image forming apparatus according to the first embodiment. FIG. 10 is a schematic graph which illustrates a potential of a photoreceptor using the charger of the image forming apparatus according to the first embodiment.

Horizontal axes of the graphs in FIGS. 9 and 10 are positions in the longitudinal direction of the charger 31. The position 0 denotes a position corresponding to a center of the image formation width. The inside of the position ±w1 corresponds to an effective image formation region. The inside of the position ±w2 (w2>w1) corresponds to the effective charging region. The vertical axis of the graph in FIG. 9 is a gap (distance) between the charging grid 45 and the tip end portion of the electrode portion 40A. The vertical axis of the graph in FIG. 10 is a potential of the photosensitive drum 30 when being charged.

In the charger 31, the charging electrode 40 in a state of being attached is curved. As illustrated in FIG. 9, the gap between the tip end portion of the electrode portion 40A and the charging grid 45 is changed along the longitudinal direction of the charger 31. For example, a gap between the tip end portion of the electrode portion 40A which is closest to the first end portion E1 (position −w2) and the charging grid 45 is $G_F$. A gap between the tip end portion in the center (position 0) of the electrode portion 40A and the charging grid 45 is $G_C$ ($G_C$>$G_F$). The gap between the tip end portion of the electrode portion 40A, which is closest to the second end portion E2 (position +w2), and the charging grid 45 is $G_R$ ($G_R$=$G_F$). On the other hand, a gap between the tip end portion of the position −w1 and the charging grid 45, and a gap between the tip end of the position +w1 and the charging grid 45 are respectively $G_F'$ ($G_C$<$G_F'$<$G_F$) and $G_R'$ (=$G_F'$).

The plate thickness of the charging grid 45 is uniform. The charging grid 45 is disposed in parallel to the surface 30*a* of the photosensitive drum 30. The gap between the tip end portion of the electrode portion 40A and the charging grid 45 is the sum of the distance d between the charging grid 45 and the photosensitive drum 30 and the plate thickness of the charging grid 45.

The charger 31 charges the photosensitive drum 30. The smaller the gap between the tip end portion of the electrode portion 40A and the photosensitive drum 30, the larger the amount of charging of the photosensitive drum 30. For example, the smaller the gap between the electrode portion 40A and the photosensitive drum 30, the lower the potential of the photosensitive drum 30, when the photosensitive drum 30 is negatively charged. For example, as illustrated in FIG. 10, at the positions −w1, 0, and +w1, the photoreceptor potentials are $V_F$, $V_C$, $V_R$ ($V_F$=$V_R$<$V_C$, $|V_F|$=$|V_R|$>$|V_C|$).

When the photosensitive drum 30 is charged using the charger 31, the potential of the photosensitive drum 30 becomes high at the center portion compared to both end portions in the image formation region. Accordingly, when light with the same exposure energy is radiated to the photosensitive drum 30, the potential after the exposing becomes higher at the center portion. That is, a deeper (i.e., potential difference is larger) latent image potential is formed in the center portion. For this reason, negatively charged toner is easily attached to the surface 30*a* of the photosensitive drum 30 at the center portion.

According to the embodiment, the potential of the photosensitive drum 30 is intentionally changed along the longitudinal direction of the photosensitive drum 30. An amount of change is set so as to offset uneven density of an image, which occurs when a conventional electrode is used due to a factor other than the potential of the photosensitive drum.

For example, setting of the amount of the change of the photosensitive drum 30 is mainly set so as to correct non-uniformity of developing performance of the developing units 32Y, 32M, 32C, and 32K in the image width direction in.

The developing units 32Y, 32M, 32C, and 32K cause developer including toner to be in contact with the photosensitive drum 30 when the magnetic roller 32*a*, which is supported at both ends, rotates. The magnetic roller 32*a* rotates while rolling up the developer in a gap between the developing blade and the photosensitive drum 30. The magnetic roller 32*a* receives an external force through the developer. The magnetic roller 32*a* is deformed (bent) by the external force. Similarly, the photosensitive drum 30 also receives an external force through the developer. The photosensitive drum 30 is deformed (bent) by the external force in the direction opposite to the deforming direction of the magnetic roller 32*a*.

The bending deformation of the magnetic roller 32*a* and the photosensitive drum 30 causes portions with a larger amount of bending to retain a smaller amount of developer (amount of toner). Accordingly, an attached amount of toner in a center portion of an image is smaller according to the bending deformation, even when the toner is uniformly distributed on the magnetic roller 32*a*. For this reason, there is a tendency that density of the image decreases in the center portion.

Since the image forming apparatus 100 includes the charger 31, it is possible for the charger 31 to increase the potential of the photoreceptive drum 30 at a portion at which the developing performance tends to become lower. In the image forming apparatus 100, it is possible to form an electrostatic latent image having a region at which the amount of toner is larger than the other regions, even when a uniform exposure is performed on the entire regions. For this reason, in the image forming apparatus 100, it is possible to make a density of a toner image uniform in the longitudinal direction of the photosensitive drum 30.

In particular, in the charger 31, the position of the first end portion E1 and the second end portion E2 of the charging electrode 40 are defined based on the position of the abutting portions 43A and 43B. For this reason, positioning of the tip end portion of the electrode portion 40A with respect to the charging grid 45 and the photosensitive drum 30 is easy.

Hereinafter, a modification example of the first embodiment will be described.

In the above described image forming apparatus 100 according to the first embodiment, the sizes of inclined angles of the first end portion E1 and the second end portion E2 of the charging electrode 40 are the same. In addition, directions of inclining of the first end portion E1 and the second end portion E2 of the charging electrode 40 are opposite to each other. However, there is no limitation to the inclination of the first end portion E1 and the second end portion E2.

For example, it is possible to set the inclined angles of the first end portion E1 and the second end portion E2 to be different from each other. In this case, in the charger 31, it is possible to set a gap between the tip end portion of the electrode portion 40A and the surface 30*a* of the photosensitive drum. 30 to be a maximum at a position other than the image center portion.

A relationship between the inclined angles of the abutting portions 43A and 43B and the gap between the tip end portion of the electrode portion 40A and the surface 30*a* of the photosensitive drum 30 may be obtained using a calculation of the bending deformation of the belt-like portion 40B. In addition, the calculation of the bending deformation may be performed based on the whole shape of the charging electrode 40 including the shape of the electrode portion 40A. In this case, it is possible to obtain a gap with higher accuracy.

The inclines of the first end portion E1 and the second end portion E2 may be changed in each charger 31 in the image forming units 25Y, 25M, 25C, and 25K.

In the above described image forming apparatus 100 according to the first embodiment, a center portion of the charging electrode 40 in the longitudinal direction is curved in an arc shape which goes far from the photosensitive drum 30. However, there is no limitation to the direction of the curve. For example, the center portion of the charging electrode 40 in the longitudinal direction may be curved in an arc shape which is close to the photosensitive drum 30. In this case, an electrostatic latent image to which a larger amount of toner is attached is formed on both end portions in the image forming region in the width direction. The modification example is effective when density of an image is lower at an end portion of the image in the width direction, in the image forming units 25Y, 25M, 25C, and 25K.

In the above described image forming apparatus 100 according to the first embodiment, the abutting portions 43A and 43B are in flat plate shapes in each charger 31. However, the abutting portions 43A and 43B are not limited to the flat plate shapes. As the shape of the abutting portions, it is possible to adopt all shapes which may regulate the position of the first end portion E1 and the second end portion E2. For example, the abutting portions may have a convex portion which is in contact with two or more positions which are separated from each other with respect to the second side surface 40*c*. For example, the abutting portions may have a groove base which is in contact with the second side surface 40*c*, and a groove portion having a groove width in which the belt-like portion 40B fits in the plate thickness direction.

In the above described image forming apparatus 100 according to the first embodiment, the belt-like portion 40B has a rectangular shape in each charger 31. However, the belt-like portion 40B should have the belt-like shape at least in the range in which the electrode portion 40A is formed. In the belt-like portion 40B, the shape of the belt shape is not limited to a rectangular shape. For example, the width of the shape of the belt-like portion 40B in the short direction may be changed. In particular, the first end portion E1 and the second end portion E2 may have a shape in which a locking member or an elastic member may be easily locked. The shape of the first end portion E1 and the second end portion E2 is not limited to the belt shape.

In the above described image forming apparatus 100 according to the first embodiment, the second side surface 40*c* which is butted against the abutting portions 43A and 43B is a linear shape. However, the shape of the second side surface 40*c* in the first end portion E1 and the second end portion E2 is not limited to this. For example, the second side surface 40*c* may have two or more convex portions.

In the above described image forming apparatus 100 according to the first embodiment, the charging electrode 40 includes the locking holes 40*a* and 40*d* as locking units. However, as long as each of the locking units may lock the locking portion 42 and the spring 44, respectively, the locking units are not limited to a hole. For example, the locking unit may be a groove which is formed in the first side surface 40*b* or the second side surface 40*c*. The locking unit may be a protrusion which protrudes from the belt-like portion 40B in the plate thickness direction.

In the above described image forming apparatus 100 according to the first embodiment, the abutting portions 43A and 43B contact the second side surface 40*c* of the charging electrode 40 in each charger 31. However, the abutting members may contact the first side surface 40*b*.

Figure 11:
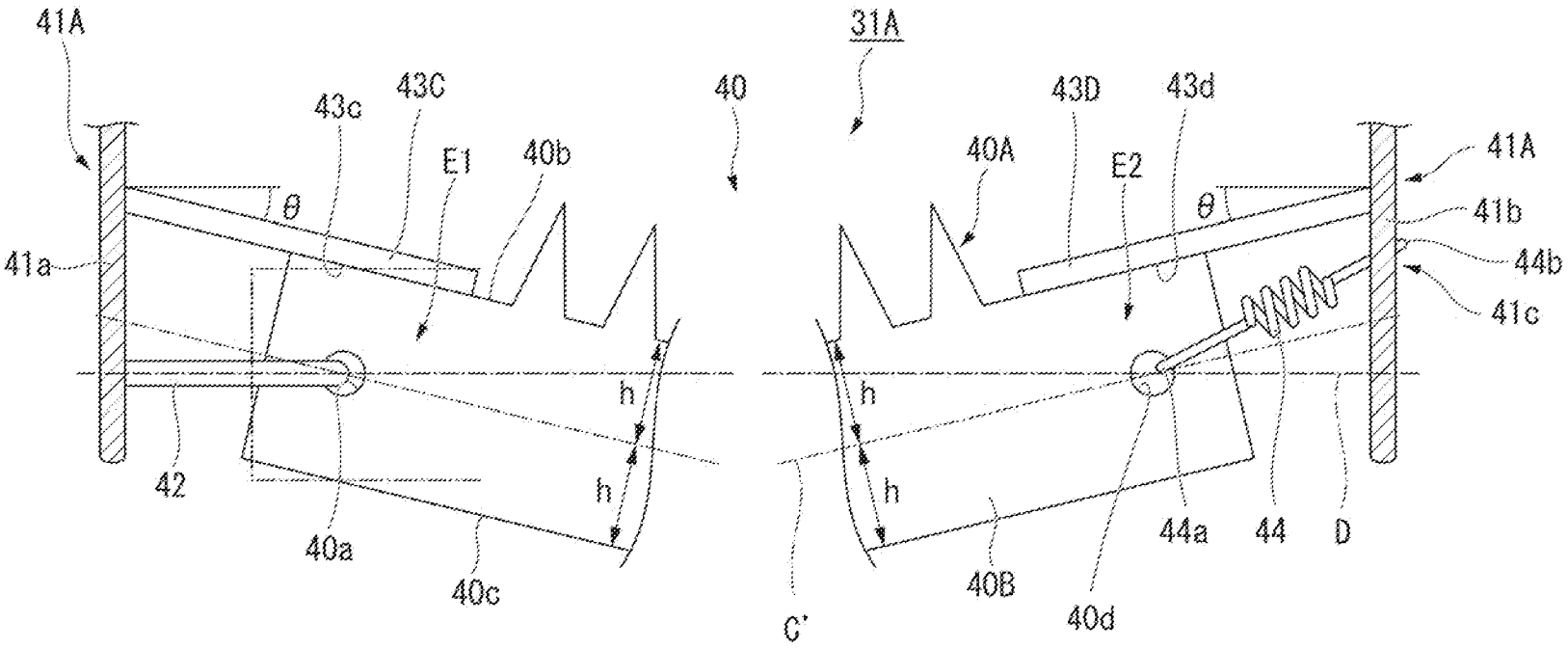
FIG. 11 is a schematic cross sectional diagram of a charger of an image forming apparatus according to a modification example of the first embodiment.

FIG. 11 is a schematic cross sectional diagram of a charger of an image forming apparatus in a modification example in the first embodiment.

FIG. 11 illustrates main portions of a charger 31A in the modification example.

The charger 31A may be used in the image forming units 25Y, 25M, 25C, and 25K instead of the charger 31 of the image forming apparatus 100 according to the first embodiment (refer to FIG. 2). Hereinafter, differences from the charger 31 will be mainly described.

The charger 31A includes a support frame 41A (electrode holding member) instead of the support frame 41. The support frame 41A includes abutting portions 43C and 43D instead of the abutting portions 43A and 43B of the charger 31.

The abutting portions 43C and 43D are formed of flat plates and are similar to a structure in which the abutting portions 43A and 43B are moved to the vicinity of the charging grid 45 in parallel. The abutting portions 43C and 43D include planar surfaces 43*c* and 43*d* (inclined plane) on the side opposite to the charging grid 45. The surfaces 43*c* and 43*d* are inclined similarly to the surfaces 43*a* and 43*b* in the first embodiment. The first side surface 40*b* of the first end portion E1 and the second end portion E2 of the charging electrode 40 contact the surfaces 43*c* and 43*d*, respectively.

In the modification example, the locking hole 41*c* in the support plate unit 41*b* is moved to the vicinity of the abutting member 43D compared to the axis line D. The spring 44 presses the first side surface 40*b* of the second end portion E2 to the abutting member 43D.

The charger 31A in the modification example can achieve a similar effect to that of the above described image forming apparatus 100 according to the first embodiment.

Second Embodiment

Hereinafter, an image forming apparatus 101 according to the second embodiment will be described with reference to drawings. In each figure, the same configuration will be given the same reference numeral. The same configuration as those in the first embodiment will be given the same reference numerals as those in the first embodiment, and descriptions thereof will be omitted.

Figure 12:
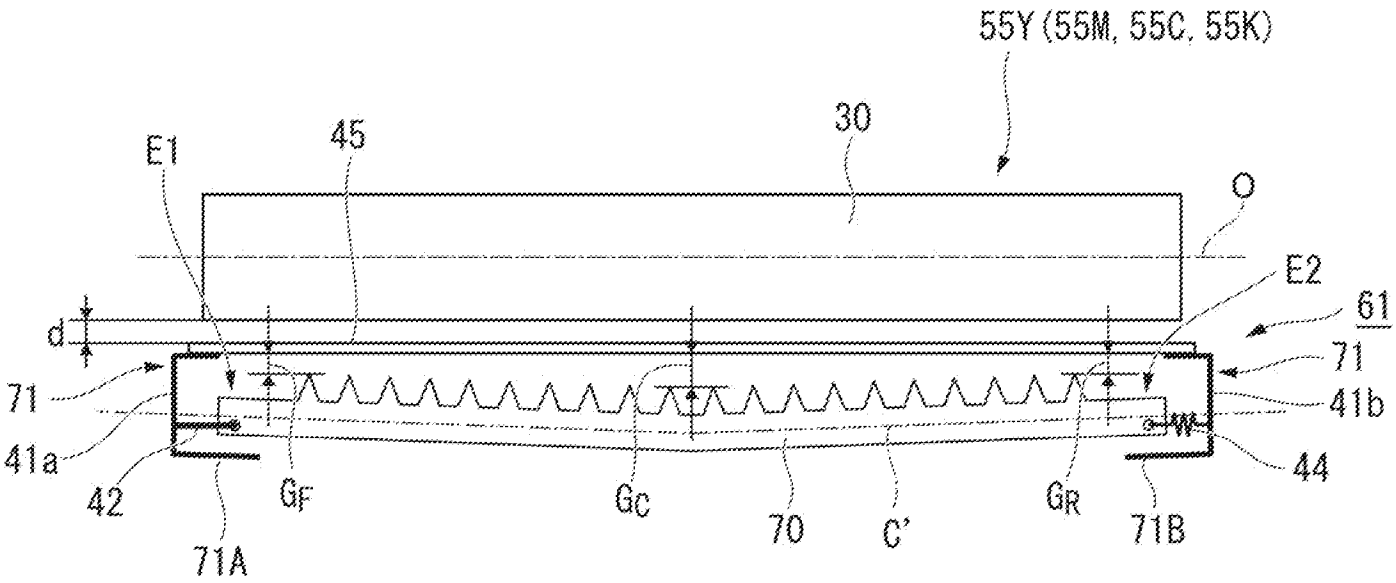
FIG. 12 is a schematic cross sectional diagram of a charger of an image forming apparatus according to a second embodiment.
Figure 13:
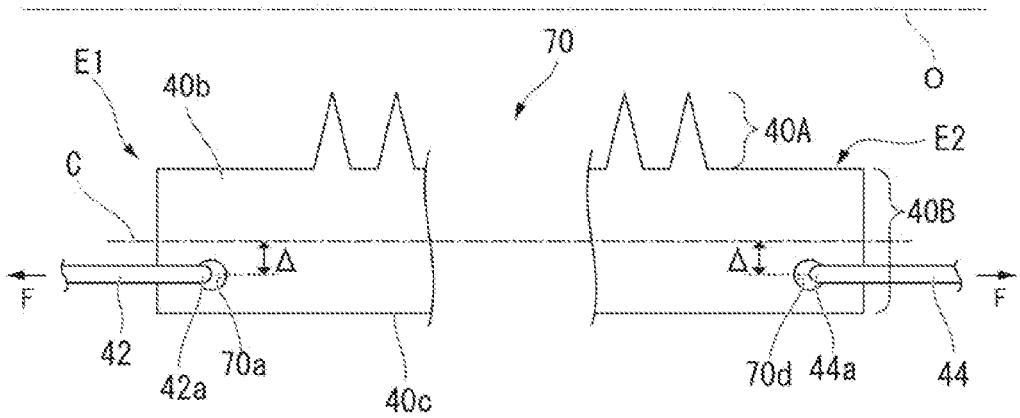
FIG. 13 is a front view of a charging electrode which is used in a charger of the image forming apparatus according to the second embodiment.

FIG. 12 is a schematic cross sectional diagram of a charger of an image forming apparatus according to a second embodiment. FIG. 13 is a front view of a charging electrode which is used in the charger of the image forming apparatus according to the second embodiment.

As illustrated in FIG. 1, the image forming apparatus 101 includes image forming units 55Y, 55M, 55C, and 55K instead of the image forming units 25Y, 25M, 25C, and 25K in the above described image forming apparatus 100 according to the first embodiment.

As illustrated in FIG. 2, each of the image forming units 55Y, 55M, 55C, and 55K includes a charger 61 instead of the charger 31 of the above described image forming apparatus 100 according to the first embodiment.

As illustrated in FIG. 12, the charger 61 includes a charging electrode 70 and a support frame 71 (electrode holding member) instead of the charging electrode 40 and the support frame 41.

As illustrated in FIG. 13, the charging electrode 70 includes locking hole 70*a* and 70*b* (locking unit) which penetrate the belt-like portion 40B in the plate thickness direction instead of the locking hole 40*a* and 40*d* of the charging electrode 40.

The locking hole 70*a* has the same shape as the locking hole 40*a*. A position of the locking hole 70*a* of the belt-like portion 40B in the longitudinal direction is the same as that of the locking hole 40*a*. A position of the locking hole 70*a* of the belt-like portion 40B in the short direction is deviated by $\Delta$ ($0<\Delta<h$) from the center axis line C towards the second side surface 40*c*.

The locking hole 70*d* has the same shape as that of the locking hole 40*d*. A position of the locking hole 70*d* of the belt-like portion 40B in the longitudinal direction is the same as that of the locking hole 40*d*. A position of the locking hole 70*d* of the belt-like portion 40B in the short direction is deviated by $\Delta$ ($0<\Delta<h$) from the center axis line C towards the second side surface 40*c*.

As illustrated in FIG. 12, the support frame 71 includes support plate portions 41*a* and 41*b* similarly to the support frame 41. A locking portion 42 is fixed to the support plate portion 41*a*. A locking hole 71*c* of which only a location is different from the locking hole 41*c* is formed in the support plate unit 41*b* instead of the locking hole 41*c*. According to the embodiment, the locking portion 42 extends in parallel to the charging grid 45. The locking hole 71*c* is formed on a front surface of the locking portion 42 which goes along the extending direction of the locking portion 42.

According to the embodiment, the locking portion 42 locks the locking hole 70*a* of the charging electrode 70 using the hook 42*a*. A hook 44*a* of the spring 44 is locked in the locking hole 70*d* of the charging electrode 70 which is locked in the locking portion 42. A hook 44*b* of the spring 44 is locked in the locking hole 71*c*. The spring 44 which is locked in the locking holes 40*d* and 71*c* is extended by being pulled. Elastic restoring force which is generated in the spring 44 works in the locking hole 40*d*, and tows the charging electrode 70.

For this reason, the charging electrode 70 is stretched between the support plate portions 41*a* and 41*b* using the locking portion 42 and the spring 44.

The support frame 71 includes rear frame portions 71A and 71B instead of the abutting portions 43A and 43B of the support frame 41.

The rear frame portion 71A is a flat plate. The rear frame portion 71A extends in parallel to the center axis line O and the charging grid 45 toward the side of the support plate unit 41*b* from an end portion of the support plate portion 41*a*. The rear frame portion 71B is a flat plate. The rear frame portion 71B extends in parallel to the center axis line O and the charging grid 45 toward the support plate portion 41*a* from an end portion of the support plate portion 41*b*.

The rear frame portions 71A and 71B extend to a position which covers a part of the locking portion 42 and the first end portion E1. In addition, the rear frame portions 71A and 71B extend to a position which covers a part of the spring 44 and the second end portion E2. The rear frame portions 71A and 71B are separated from the second side surface 40*c* of the charging electrode 70. The rear frame portions 71A and 71B are not in contact with any of the locking portion 42, the charging electrode 70, and the spring 44.

With such a configuration, as illustrated in FIG. 13, in the charging electrode 70, the locking hole 70*d* of the second end portion E2 is pulled by the spring 44. The locking hole 70*a* of the first end portion E1 is locked in the hook 42*a* of the locking portion 42. For this reason, an external force F which pulls and separates the locking holes 70*a* and 70*d* from each other works in the locking holes 70*a* and 70*d* of the charging electrode 70. The external force F is equal to the elastic restoring force corresponding to a magnitude of extension of the spring 44.

Due to the external force F, elastic deformation in which the locking holes 70*a* and 70*d* are extended therebetween occurs. However, the locking holes 70*a* and 70*d* are biased to the side of the second side surface 40*c* by a distance Δ from the center axis line C of the belt-like portion 40B. For this reason, a magnitude of extension on the side of the second side surface 40*c* in the longitudinal direction with respect to the center axis line C is larger than that on the side of the first side surface 40*b* in the longitudinal direction with respect to the center axis line C.

The electrode portion 40A is formed on the first side surface 40*b*. However, the electrode portion 40A protrudes toward the short direction in a needle shape. For this reason, the electrode portion 40A cannot resist tension in the longitudinal direction.

Figure 14:
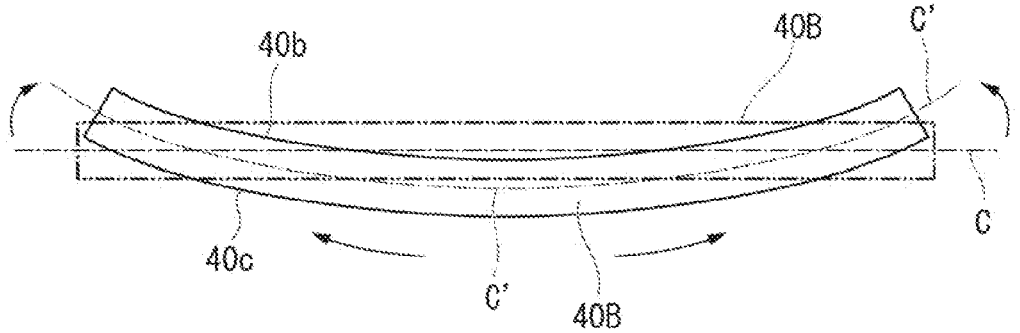
FIG. 14 is a schematic diagram which illustrates deformation of the charger of the image forming apparatus according to the second embodiment.

Accordingly, as illustrated in FIG. 14, the belt-like portion 40B curves in an arc shape in which the side of the second side surface 40*c* becomes a convex shape, and the side of the first side surface 40*b* becomes a concave shape.

The schematic curved shape of the belt-like portion 40B is obtained from bending deformation of a rectangular cross sectional beam which is obtained when a bending moment of FxΔ is operated in the first end portion E1 and the second end portion E2 of the belt-like portion 40B. In this case, the center axis line C becomes a neutral axis of the bending.

In this manner, according to the embodiment, both end portions of the belt-like portion 40B are pulled in the longitudinal direction at a position which is deviated from the neutral axis of bending. The belt-like portion 40B which is stretched on the support frame 71 is bent in the plate plane. The belt-like portion 40B is curved in an arc shape which goes far from the photosensitive drum 30 in an intermediate portion in the longitudinal direction. The center axis line C of the belt-like portion 40B becomes a center axis line C' which is curved in an arc shape.

The electrode portion 40A protrudes from the first side surface 40*b* of the belt-like portion 40B. Each tip end portion of the electrode portion 40A is disposed in line along the arc-shaped curved line. The arc-shaped curved line is apart by a constant distance from the first side surface 40*b* and aligned along the curved shape of the belt-like portion 40B.

The magnitude of the curve of the electrode portion 40A may be changed to an appropriate magnitude by changing any of the magnitude of the external force F and the magnitude of the position Δ of the locking holes 70*a* and 70*d*.

The distance between the tip end portion of the electrode portion 40A and the charging grid 45, or the distance between the tip end portion of the electrode portion 40A and the surface 30*a* of the photosensitive drum 30 may be adjusted using a position of the locking portion 42 with respect to the support plate portion 41*a*.

In the image forming apparatus 101 with such a configuration, a holding structure of the charging electrode 70 in the charger 61 is different from that using the above described support frame 41 according to the first embodiment. However, the charging electrode 70 is held by being curved similarly to the charging electrode 40. For this reason, similarly to the above described first embodiment, a gap between the tip end portion of the electrode portion 40A and the charging grid 45 is changed along the longitudinal direction of the charger 61.

The image forming apparatus 101 includes the charger 61. For this reason, similarly to the above described first embodiment, in the image forming apparatus 101, the photoreceptor potential may be changed along the longitudinal direction of the photosensitive drum 30. For example, the image forming apparatus 101 may make a density of a toner image uniform in the longitudinal direction of the photosensitive drum 30 by increasing the photoreceptor potential at a portion at which the developing performance is lower.

According to the embodiment, the charging electrode 70 is curved only by the pulling force. For this reason, abutting portion for determining a curved shape is not necessary. A configuration of the support frame 71 is simple. In the support frame 71, a contact portion with the charging electrode 70 to which a high voltage is applied is small. For this reason, it is possible to reduce an amount of an expensive high voltage resistant material used for the support frame 71.

Hereinafter, a modification example of the second embodiment will be described.

In the above described image forming apparatus 101 according to the second embodiment, both magnitudes of deviation of the locking hole 70*a* and 70*d* in the short direction with respect to the center axis line C are Δ. However, the magnitudes of deviation of the locking hole 70*a* and 70*d* in the short direction with respect to the center axis line C may be different from each other.

In this case, the bending moments which work in the first end portion E1 and the second end portion E2 are different. For this reason, in the image forming apparatus 101 in the modification example, it is possible to change a position at which the gap between the tip end portion of the electrode portion 40A and the surface 30*a* of the photosensitive drum 30 becomes a maximum at a position other than the image center portion.

A relationship between the magnitudes of deviation of the locking hole 70*a* and 70*d* with respect to the center axis line C in the short direction and the gap between the tip end portion of the electrode portion 40A and the surface 30*a* of the photosensitive drum 30 may be obtained using a calculation of bending deformation of the belt-like portion 40B. In addition, the calculation of the bending deformation may be performed based on the entire shape of the charging electrode 70 including the shape of the electrode portion 40A. In this case, it is possible to obtain the gap with higher accuracy.

In the above described image forming apparatus 101 according to the second embodiment, the curved shape of the charging electrode 70 is similar to that of the above described charging electrode 40 according to the first embodiment. However, the curved shape of the charging electrode 70 is not limited to the arc shape in which the center portion in the longitudinal direction goes far from the photosensitive drum 30 similarly to the above described modification example of the first embodiment. For example, the charging electrode 70 may have the locking hole 70*a* and 70*d* between the center axis line C and the first side surface 40*b*. In this case, the direction of the convex portion in the curve of the charging electrode 70 becomes opposite to that in the second embodiment which is described above.

According to at least one of the above described embodiments, since the image forming apparatus includes the electrode holding member which changes the distance between the tip end portion of the electrode unit of the charging electrode in the protruding direction and the surface of the photoreceptor along the formation width of the electrostatic latent image, by holding the first end portion and the second end portion of the charging electrode in the longitudinal direction, it is possible to change the photoreceptor potential along the formation width of the electrostatic latent image. It is possible to adjust density of a toner image along the longitudinal direction of the photoreceptor.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image holding module comprising:

a photoreceptor configured to hold an electrostatic latent image on a surface thereof;

a charging electrode that extends in a width direction of the photoreceptor and is configured to charge the surface of the photoreceptor, the charging electrode including a base portion and a discharging portion disposed between the base portion and the photoreceptor and from which electricity is discharged towards the photoreceptor; and a holding unit that holds the charging electrode and deforms the charging electrode, wherein the holding unit includes a first end portion having a surface that is inclined with respect to the surface of the photoreceptor, against which the base portion of the charging electrode is pressed so that the distance between the discharging portion and the surface of the photoreceptor at a first end of the photoreceptor is smaller than the distance between the discharging portion and the surface of the photoreceptor at a more central position of the photoreceptor, and a second end portion having a surface that is inclined with respect to the surface of the photoreceptor, against which the base portion of the charging electrode is pressed by a spring so that the distance between the discharging portion and the surface of the photoreceptor at a second end of the photoreceptor is smaller than the distance between the discharging portion and the surface of the photoreceptor at a more central position of the photoreceptor.

2. The image holding module according to claim 1, wherein a surface of the base portion that faces away from the photoreceptor is pressed against the first and second end portions.

3. The image holding module according to claim 1, wherein the spring is connected to a position of the base portion that are offset from a center longitudinal axis of the base portion.

4. The image holding module according to claim 1, wherein the discharging portion includes a plurality of pointed portions directed towards the photoreceptor, and the distance between the discharging portion and the surface of the photoreceptor is measured from an end of the pointed portions to the surface of the photoreceptor.

5. The image holding module according to claim 1, further comprising:

a charging grid disposed between the photoreceptor and the charging electrode and configured to cause the charge applied to the surface of the photoreceptor by the charging electrode to become more uniform, wherein a distance between the discharging portion and the charging grid is different along the width direction of the photoreceptor.

6. The image holding module according to claim 5, wherein a distance between the charging grid and the photoreceptor is constant in the direction along the width direction of the photoreceptor.

7. The image holding module according to claim 1, further comprising:

a developing member that is in contact with the photoreceptor and configured to press against the photoreceptor when supplying toner to the photoreceptor, wherein the photoreceptor is deformed as a result of non-uniform pressing force applied thereto by the developing member, and the charging electrode is deformed in a shape corresponding to the deformation of the photoreceptor.

8. An image forming apparatus comprising:

an image forming unit configured to form a toner image to be transferred onto a sheet; and a fixing unit configured to fix the toner image on the sheet, wherein the image forming unit includes a photoreceptor configured to hold, on a surface thereof, an electrostatic latent image on which toner is supplied to form the toner image, a charging electrode that extends in a width direction of the photoreceptor and is configured to charge the surface of the photoreceptor, the charging electrode including a base portion and a discharging portion disposed between the base portion and the photoreceptor and from which electricity is discharged towards the photoreceptor, and a holding unit that holds the charging electrode and deforms the charging electrode, and the holding unit includes a first end portion having a surface that is inclined with respect to the surface of the photoreceptor, against which the base portion of the charging electrode is pressed so that the distance between the discharging portion and the surface of the photoreceptor at a first end of the photoreceptor is smaller than the distance between the discharging portion and the surface of the photoreceptor at a more central position of the photoreceptor, and a second end portion having a surface that is inclined with respect to the surface of the photoreceptor, against which the base portion of the charging electrode is pressed by a spring so that the distance between the discharging portion and the surface of the photoreceptor at a second end of the photoreceptor is smaller than the distance between the discharging portion and the surface of the photoreceptor at a more central position of the photoreceptor.

9. The image forming apparatus according to claim 8, wherein a surface of the base portion that faces away from the photoreceptor is pressed against the first and second end portions.

10. The image forming apparatus according to claim 8, wherein the spring is connected to a position of the base portion that are offset from a center longitudinal axis of the base portion.

11. The image forming apparatus according to claim 8, wherein the discharging portion includes a plurality of pointed portions directed towards the photoreceptor, and the distance between the discharging portion and the surface of the photoreceptor is measured from an end of the pointed portions to the surface of the photoreceptor.

12. The image forming apparatus according to claim 8, wherein the image forming unit further includes a charging grid disposed between the photoreceptor and the charging electrode and configured to cause the charge applied to the surface of the photoreceptor by the charging electrode to become more uniform, and a distance between the discharging portion and the charging grid is different along the width direction of the photoreceptor.

13. The image forming apparatus according to claim 12, wherein a distance between the charging grid and the photoreceptor is constant in the direction along the width direction of the photoreceptor.

14. The image forming apparatus according to claim 8, wherein the image forming unit further includes a developing member that is in contact with the photoreceptor and configured to press against the photoreceptor when supplying toner to the photoreceptor, the photoreceptor is deformed as a result of non-uniform pressing force applied thereto by the developing member, and the charging electrode is deformed in a shape corresponding to the deformation of the photoreceptor.

15. An image holding module comprising:

a photoreceptor configured to hold an electrostatic latent image on a surface thereof;

a charging electrode that is configured to charge the surface of the photoreceptor; and a developing member that is in contact with the photoreceptor and configured to press against the photoreceptor when supplying toner to the photoreceptor, wherein the photoreceptor is deformed when a non-uniform pressing force is applied thereto by the developing member, the charging electrode includes a base portion and a discharging portion that is disposed between the base portion and the photoreceptor and from which electricity is discharged towards the photoreceptor, and the charging electrode has a shape corresponding to the deformation of the photoreceptor when the non-uniform pressing force is applied thereto by the developing member, such that a distance between the discharging portion and the surface of the photoreceptor is different along the width direction of the photoreceptor when the photoreceptor is not deformed.

16. The image holding module according to claim 15, further comprising:

a holding unit that holds the charging electrode, wherein a surface of the base portion that faces away from the photoreceptor is pressed against the holding unit.

17. The image holding module according to claim 16, wherein the surface of the base portion is pressed against the holding unit by a spring that is connected to a position of the base portion that are offset from a center longitudinal axis of the base portion.

18. The image holding module according to claim 15, wherein the discharging portion includes a plurality of pointed portions directed towards the photoreceptor, and the distance between the discharging portion and the surface of the photoreceptor is measured from an end of the pointed portions to the surface of the photoreceptor.

19. The image holding module according to claim 15, further comprising:

a charging grid disposed between the photoreceptor and the charging electrode and configured to cause the charge applied to the surface of the photoreceptor by the charging electrode to become more uniform, and a distance between the discharging portion and the charging grid is different along the width direction of the photoreceptor.

20. The image holding module according to claim 19, wherein a distance between the charging grid and the photoreceptor is constant in the direction along the width direction of the photoreceptor when the photoreceptor is not deformed.

* * * * *